US005355545A

United States Patent [19]

Hoagland

[11] Patent Number: 5,355,545

[45] Date of Patent: Oct. 18, 1994

[54] HAND AND FINGERNAIL CLEANING BRUSH

[75] Inventor: Mary M. Hoagland, Cincinnati, Ohio

[73] Assignee: Vining Industries, Inc., Springfield, Ohio

[21] Appl. No.: 2,151

[22] Filed: Jan. 11, 1993

[51] Int. Cl.[5] ..... A46B 9/00

[52] U.S. Cl. ..... 15/111; 15/143.1; 15/167.3; 132/73.5; D4/118; D4/129

[58] Field of Search ..... 15/105, 111, 143.1, 15/160, 167.3; 132/73.5; D4/118, 129, 130

[56] References Cited

U.S. PATENT DOCUMENTS

| | | | |
|---|---|---|---|
| D. 153,413 | 4/1949 | Baumgartner . | |
| D. 266,458 | 10/1982 | Gonsalves | D4/129 |
| D. 269,565 | 7/1983 | Goldstaub | D4/129 |
| D. 282,604 | 2/1986 | Whitaker . | |
| D. 291,029 | 7/1987 | Purvis et al. . | |
| D. 329,752 | 9/1992 | Murphy et al. . | |
| 380,476 | 4/1888 | Coursen | 15/111 |
| 1,529,321 | 3/1925 | Pearson | 132/73.5 |
| 2,279,533 | 4/1942 | Shore | 15/167.3 |
| 2,439,922 | 4/1948 | Chappell et al. . | |
| 2,981,964 | 5/1961 | Downing | 15/111 |
| 3,387,313 | 6/1968 | Smith et al. . | |
| 3,467,978 | 9/1969 | Golden . | |
| 3,966,335 | 6/1976 | Abramson . | |
| 4,365,380 | 12/1982 | Passler | 15/111 |
| 4,479,277 | 10/1984 | Gilman et al. . | |
| 4,757,571 | 7/1988 | Young . | |

FOREIGN PATENT DOCUMENTS

| | | | |
|---|---|---|---|
| 53045 | 9/1933 | Norway | 15/105 |
| 8041 | of 1893 | United Kingdom | 15/111 |
| 0535671 | 1/1923 | United Kingdom | 15/143.1 |

*Primary Examiner*—David A. Scherbel
*Assistant Examiner*—Randall E. Chin
*Attorney, Agent, or Firm*—Panitch Schwarze Jacobs & Nadel

[57] ABSTRACT

A hand brush having an elongated bristle block body, with substantially planar top and bottom surfaces. The brush bristles extend downwardly from the bottom of the body. The forward end of the body is provided with a forwardly extending nose. A handle has a first portion extending upwardly from the nose and the adjacent forward portion of the top of the body and a second grip portion directed rearwardly above the top of the body. The nose is narrower than the forward end of the body forming a recessed alcove to either side of the nose. A pair of mirror image fingernail cleaners extend forwardly from the forward end of the brush body along and spaced from each side of the nose. The forward ends of the fingernail cleaners are sharp enough to remove grime from beneath the user's nails, but do not represent a hazard to the user since they are set back in their respective alcoves and do not extend beyond the brush nose.

19 Claims, 2 Drawing Sheets

HAND AND FINGERNAIL CLEANING BRUSH

TECHNICAL FIELD

The invention relates to a hand and fingernail cleaning brush, and more particularly to such a brush provided at its forward end with a pair of mirror image fingernail cleaners located in recessed alcoves at either side of the forward end of the brush.

BACKGROUND ART

Prior art workers have devised a number of hand cleaning brushes provided with means for removing grime from beneath the fingernails. Perhaps the most frequently encountered brush of this type is one in which the brush body is provided with standard scrubbing bristles depending from its bottom surface and a series of rows of short bristles extending upwardly from its upper surface and designed specifically to scrub the fingernails. Such an arrangement often works reasonably well. There are times, however, when stubborn dirt beneath the nails requires an actual scraping action. Under these circumstances, it is not uncommon for one to use a separate tool, such as a pocketknife to accomplish this purpose.

Prior art workers have developed hand brushes provided with scraping-type fingernail cleaners. U.S. Pat. No. 3,467,978 teaches such a brush in several embodiments, each provided with a pointed fingernail cleaner. Since the fingernail cleaner is completely exposed, some care must be taken in the handling of this brush. U.S. Pat. No. 4,479,277 teaches a hand brush provided with a fingernail cleaner shiftable between a retracted stowed position and an extended position for use. U.S. Pat. No. 3,387,313 teaches a brush provided with a pair of identical fingernail cleaners, one located at each end of the brush. While the fingernail cleaners are exposed and some care must be employed in the use of the brush, they are, nevertheless, less exposed than the fingernail cleaners of the brushes of U.S. Pat. No. 3,467,978 in that neither fingernail cleaner extends beyond its respective end of the brush body.e The present invention is based upon the discovery that a hand and fingernail cleaning brush can be provided which is safer, easier and more convenient to use. The brush has a body with the usual hand scrubbing bristles extending downwardly from its bottom surface. At its forward end, the brush is provided with a centrally located nose. The nose and the forward end of the brush body form a pair of recessed alcoves at either side of the nose. A pair of mirror image fingernail cleaners is provided, each fingernail cleaner extending forwardly of the brush body forward end and being located in one of the recessed alcoves. By virtue of their location, the user is protected from the cleaning ends of the fingernail cleaners. By providing a mirror image pair of fingernail cleaners at the same end of the brush, one cleaner can be used for the thumb of a hand, while the other cleaner may be used for the fingers of the same hand, the thumb and fingers being opposed. In addition, the brush can be used to clean both of the user's hands and the fingernails thereof with equal ease. The brush is also provided with an easily grasped handle facilitating its use.

DISCLOSURE OF THE INVENTION

According to the invention, there is provided a hand brush having an elongated bristle block body, the brush bristles extending downwardly from the body bottom surface. At its forward end, the body is provided with a centrally located, forwardly extending, integral nose. The nose is narrower than the forward end of the body, and the nose sides and the forward end of the body form a recessed alcove at each side of the nose. A pair of mirror image fingernail cleaners extend forwardly from the forward end of the brush body alongside and spaced from the nose, each fingernail cleaner being located in one of the recessed alcoves. The forward ends of the fingernail cleaners are configured to remove grime from beneath the user's nails, and are located slightly behind the forwardmost portion of the nose.

The hand and fingernail cleaning brush is provided with a handle. The handle has a first upstanding portion which extends upwardly from the nose and the adjacent forward portion of the top surface of the brush body, and a second grip portion directed rearwardly above the top surface of the brush body. The handle provides a downwardly and forwardly sloping portion terminating at the forwardmost part of the nose and providing a surface to be gripped by the thumb of the user.

DETAILED DESCRIPTION OF THE INVENTION

Figure 1:
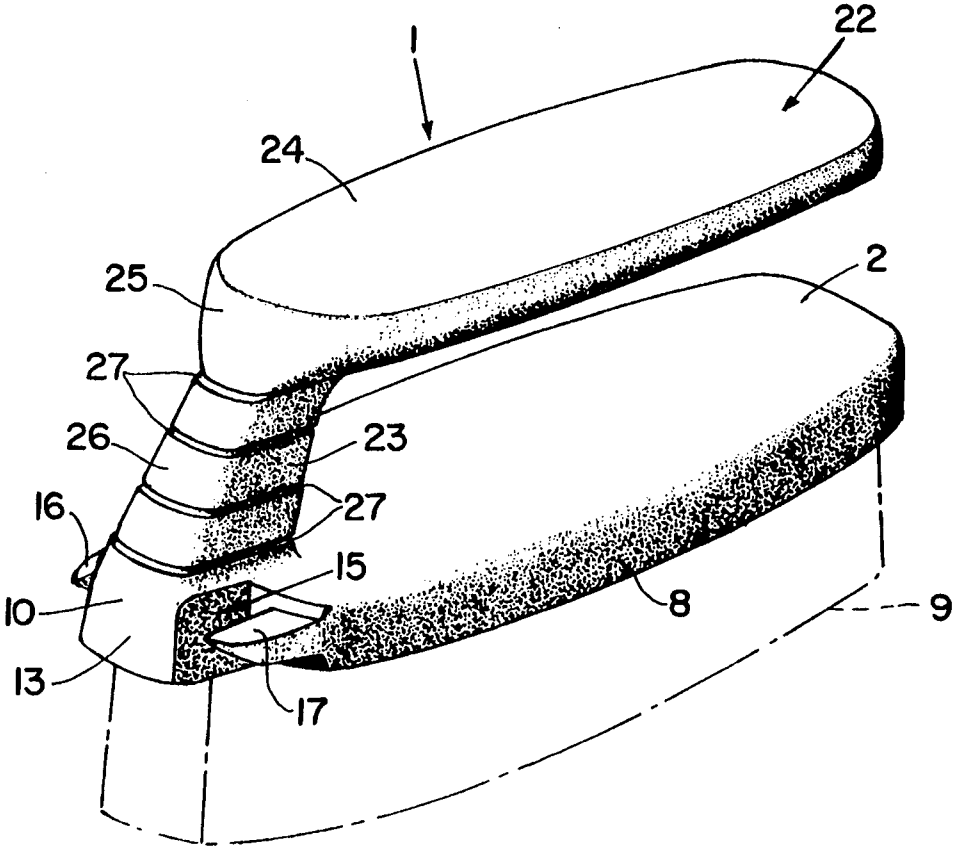
FIG. 1 is a top, front, left side perspective view of the hand and fingernail cleaning brush of the present invention, with the bristles indicated by broken lines.

Throughout the drawings, like parts have been given like index numerals. The hand and fingernail cleaning brush of the present invention is generally indicated at 1 and comprises an elongated bristle block body 2. The body 2 has a substantially planar top surface 3, a substantially planar bottom surface 4, a gently curved rear end 5, a gently curved forward end 6, and gently curved longitudinal sides 7 and 8. A generally conventional array of bristles extends downwardly from the bottom surface 4 of the body 2 and is indicated in FIGS. 1, 3, 4, 5 and 6 by broken lines at 9.

At its forward end, the body 2 is provided with a forwardly extending nose 10 having substantially parallel sides 11 and 12 and a slightly curved forward surface 13.

Figure 2:
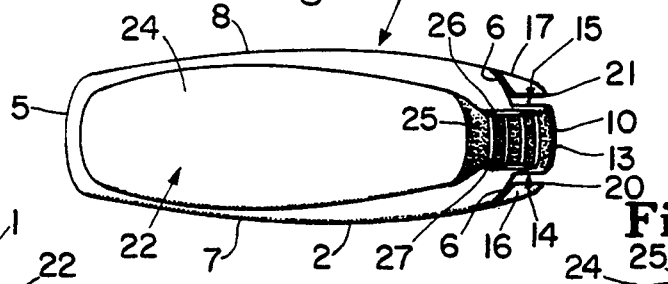
FIG. 2 is a top view of the brush of FIG. 1.

The sides 11 and 12 of nose 10, together with the adjacent portions of the forward end 6 of body 2 form a recessed alcove at each side of nose 10. These alcoves are generally indicated at 14 and 15 in FIG. 2.

There is located in each of the alcoves 14 and 15 a fingernail cleaner 16 and 17, respectively. The fingernail cleaner 16 extends forwardly in alcove 14 from the forward end 6 of body 2 in parallel spaced relationship to the side 11 of nose 10. Similarly, the fingernail cleaner 17 extends forwardly in alcove 15 from the forward end 6 of body 2 in parallel spaced relationship to the side 12 of nose 10. As is most clearly shown in FIGS. 3 and 5, the fingernail cleaners 16 and 17 have upper surfaces which are essentially coplanar lying in a plane slightly below that of the top surface 3 of body 2.

The fingernail cleaners 16 and 17 have bottom surfaces which are substantially coplanar and are inset slightly above the plane of the bottom surface 4 of body 2. The bottom surfaces slope gently in an upward and forward direction.

Figure 5:
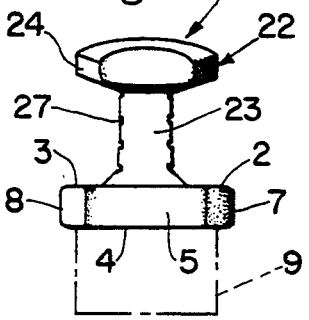
FIGS. 5 and 6 are respectively rear and front elevational views of the brush of FIG. 1 with the bristles indicated by broken lines.
Figure 6:
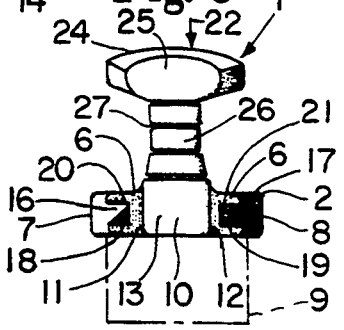
Figure 3:
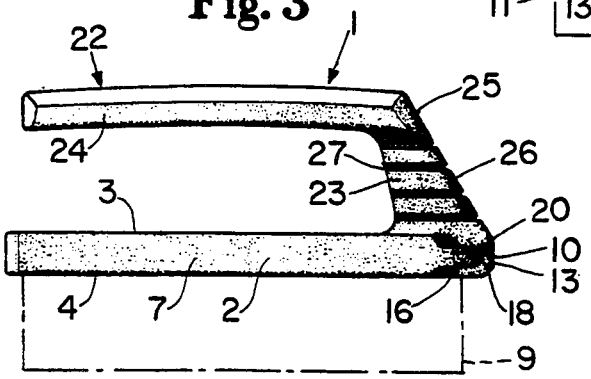
FIG. 3 is a right side elevational view of the brush of FIG. 1 with the bristles shown in broken lines.
Figure 4:
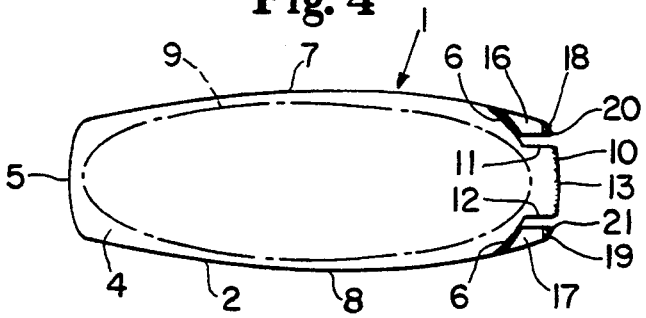
FIG. 4 is a bottom view of the brush of the present invention with the bristles indicated by broken lines.

As is clearly shown in FIGS. 3, 4 and 5, the forwardmost ends of fingernail cleaners 16 and 17 are chamfered downwardly and rearwardly as at 18 and 19, respectively. This provides the fingernail cleaners 16 and 17 with cleaning edges and cleaning points 20 and 21 respectively. It will be noted that the forwardmost ends of fingernail cleaners 16 and 17, represented by points 20 and 21, respectively, do not extend beyond the forward surface 13 of nose 10. It will further be noted that the outside surfaces of fingernail cleaners 16 and 17 constitute a continuation of the body sides 7 and 8, respectively, curving inwardly to match the curve of the forwardmost surface 13 of nose 10. Thus, while the fingernail cleaners 16 and 17 are readily accessible, their location in alcoves 14 and 15, respectively, and their general configuration assure that they do not render use of the brash 1 hazardous.

It is within the scope of the invention to provide the hand and fingernail cleaning brush 1 with a single fingernail cleaner 16 or 17. It is preferred, however, to provide both and it is also significant that both fingernail cleaners are at the same end of the brush. This arrangement not only enables the finger and thumbnails of both hands to be cleaned with equal facility, but also enables, for a given hand, the use of one of the fingernail cleaners 16 and 17 for the thumbnail and the other of the fingernail cleaners 16 and 17 for the fingernails, since the thumb and fingers of hand are opposed. It will be apparent that right or lefthandedness on the part of the user makes no difference.

The hand and fingernail cleaning brush 1 is preferably provided with a handle. The handle is generally indicated at 22 and comprises an upstanding portion 23 and a grip portion 24. The portion 23 extends upwardly from the nose 10 and the adjacent forward portion of the top surface 3 of body 2. At its upper end, handle portion 23 supports grip portion 24 which extends rearwardly therefrom over the top surface 3 of body 2 and in spaced relationship thereto.

It will be noted that the forwardmost part of handle portion 24 terminates in a downwardly and forwardly sloping surface 25. The forwardmost part of handle portion 23 has a corresponding downwardly and forwardly sloping surfaces 26. The surfaces 25 and 26 slope downwardly and forwardly to the forwardmost surface 13 of nose 10.

The grip portion 24 of handle 22 is relatively wide from side-to-side. Similarly, the handle 22 is relatively thin from top to bottom. As a consequence, the grip portion 24 of handle 22 can be readily grasped by the fingers of either hand, with the palm of the grasping hand abutting the top surface of handle portion 24. At the same time, the forward surfaces 25 and 26 of handle portions 23 and 24 provide an overall surface which may be easily grasped by the user's thumb. The handle portion 23 may be provided with a series of grooves 27 which extend about the sides and front thereof. The grooves 27 not only enhance the appearance of the brush 1, but also can serve to increase the grip of the thumb on the forward sloping surfaces of the handle. In addition, some or all of the surfaces of the portions 23 and 24 of handle 22 may be provided with texturing (not shown), if deisred. The same is true, of course, of the body portion 2.

The body 2, the nose 10, the fingernail cleaners 16 and 17, and the handle 22 lend themselves well to being molded of an appropriate plastic material, or the like. Preferably, all of these parts of the brush 1 constitute an integral, one-piece structure.

Modifications may be made in the invention without departing from the spirit of it.

What is claimed:

1. A hand and fingernail cleaning brush comprising an elongated bristle block body having a top surface, a bottom surface, body sides, forward and rearward ends, a plurality of bristles extending downwardly from said bottom surface, a recessed alcove formed in said body at the juncture of said forward end of said body and one of said body sides, a fixed fingernail cleaner extending forwardly in said alcove and terminating in a forward cleaning end located slightly rearwardly of said body forward end when in a fingernail cleaning position.

2. The hand and fingernail cleaning brush claimed in claim 1 including a handle, said handle having a first upstanding portion extending upwardly from said top of said body and a second grip portion extending rearwardly along and above said brush body top surface.

3. The hand and fingernail cleaning brush claimed in claim 2 wherein said second grip portion of said handle is shaped to be abutted by the palm and grasped by the fingers of the user's hand, said handle having a forward surface sloping forwardly and downwardly to said body forward end and comprising a surface for engagement by the user's thumb.

4. The hand and fingernail cleaning brush claimed in claim 1, comprising a plurality of recessed alcoves, each alcove of said plurality of alcoves having a fixed fingernail cleaner extending therefrom.

5. The hand and fingernail cleaning brush claimed in claim 4 including a handle having an upstanding portion extending upwardly from said top of said body at a handle junction position of said top of said body wherein first and second recessed alcoves are disposed in the vicinity of said handle junction position.

6. A hand and fingernail cleaning brush comprising an elongated bristle block body having a top surface, a bottom surface sides, a rearward end and a forward end, a plurality of bristles extending downwardly from said bottom surface, a nose located centrally of and extending forwardly of said forward end, said nose having sides, a forward end, and a bottom surface coplanar with said body bottom surface, said nose sides and the adjacent portions of said body forward end forming a recessed alcove at each side of said nose, a pair of mirror image fingernail cleaners each extending forwardly from said forward end of said body within one of said alcoves and in parallel spaced relationship to the adjacent one of said nose sides, each of said fingernail cleaner terminating in a forward cleaning end located slightly rearwardly of said nose forward end.

7. The hand and fingernail cleaning brush claimed in claim 6 wherein the forward ends of said fingernail cleaners are chamfered downwardly and rearwardly.

8. The hand and fingernail cleaning brush claimed in claim 6 wherein said nose and said fingernail cleaners comprise integral, one-piece parts of said body.

9. The hand and fingernail cleaning brush claimed in claim 6 wherein said top and bottom surfaces of said body are substantially planar, said fingernail cleaners having top surfaces lying in a plane parallel to and below the plane of said body top surface and bottom surfaces lying in a plane inset above the plane of said body bottom surface and sloping gently in an upwardly and forward direction.

10. The hand and fingernail cleaning brush claimed in claim 6 including a handle, said handle having a first upstanding portion extending upwardly from said nose and the adjacent forward portion of said top of said body and a second grip portion extending rearwardly along and above said brush body top surface.

11. The hand and fingernail cleaning brush claimed in claim 10 wherein said handle comprises an integral part of said brush body.

12. The hand and fingernail cleaning brush claimed in claim 10 wherein said second grip portion of said handle is shaped to be abutted by the palm and grasped by the fingers of the user's hand, said handle having a forward surface sloping forwardly and downwardly to said nose forward end and comprising a surface for engagement by the user's thumb.

13. The hand and fingernail cleaning brush claimed in claim 6 wherein said fingernail cleaners have exterior side surfaces comprising continuations of the adjacent body side surfaces.

14. The hand and fingernail cleaning brush claimed in claim 6, comprising a plurality of recessed alcoves, each alcove of said plurality of alcoves having a fixed fingernail cleaner extending therefrom.

15. The hand and fingernail cleaning brush claimed in claim 14 including a handle having an upstanding portion extending upwardly from said top of said body at a handle junction position of said top of said body wherein first and second recessed alcoves are disposed in the vicinity of said handle junction position.

16. A hand and fingernail cleaning brush comprising an elongated bristle block body having a top surface, a bottom surface, sides, a rearward end and a forward end, a plurality of bristles extending downwardly from said bottom surface, a nose located centrally of and extending forwardly of said forward end, said nose having sides, a forward end and a bottom surface coplanar with said body bottom surface, said nose sides and the adjacent portions of said body forward end forming a recessed alcove at each side of said nose, at least one fingernail cleaner extending forwardly from said forward end of said body within one of said alcoves and in parallel spaced relationship to the adjacent one of said nose sides, said at least one fingernail cleaner terminating in a forward cleaning end located slightly rearwardly of said nose forward end.

17. The hand and fingernail cleaning brush claimed in claim 16 including a handle, said handle having a first upstanding portion extending upwardly from said nose and the adjacent forward portion of said top of said body and a second grip portion extending rearwardly along and above said brush body top surface.

18. The hand and fingernail cleaning brush claimed in claim 16, comprising a plurality of recessed alcoves, each alcove of said plurality of alcoves having a fixed fingernail cleaner extending therefrom.

19. The hand and fingernail cleaning brush claimed in claim 18 including a handle having an upstanding portion extending upwardly from said top of said body at a handle junction position of said top of said body wherein first and second recessed alcoves are disposed in the vicinity of said handle junction position.

* * * * *